United States Patent [19]

Rao

[11] 3,956,918

[45] May 18, 1976

[54] SPECIAL CRIMPING COLLET MECHANISM WITH REELING AND UNREELING TECHNIQUE ON STRIP CONTACTS

[75] Inventor: Anumolu S. Rao, Broadview, Ill.

[73] Assignee: Bunker Ramo Corporation, Oak Brook, Ill.

[22] Filed: Oct. 21, 1974

[21] Appl. No.: 516,643

[52] U.S. Cl. ..... 72/402; 29/203 D; 29/203 DS; 29/203 DT; 29/517; 29/630 R

[51] Int. Cl.[2] ..... B21D 41/00; B21J 7/16

[58] Field of Search ..... 72/402; 29/629, 630 R, 29/505, 510, 516, 517, 203 D, 203 DT, 203 DS, 237; 339/258 R, 258 P; 242/75.4, 156, 156.2

[56] References Cited

UNITED STATES PATENTS

| | | | |
|---|---|---|---|
| 2,810,532 | 10/1957 | Zeier et al. | 242/155 R |
| 3,000,591 | 9/1961 | Backlin | 242/155 R |
| 3,085,316 | 4/1963 | Nelson | 29/613 |
| 3,568,494 | 3/1971 | Geisman | 72/402 |
| 3,738,588 | 6/1973 | Ayers | 242/75.4 X |
| 3,750,452 | 8/1973 | Frank | 29/237 X |

*Primary Examiner*—Victor A. DiPalma
*Attorney, Agent, or Firm*—D. R. Bair; F. M. Arbuckle

[57] ABSTRACT

The following specification describes the crimping of a hood on each of a series of stamped contacts attached to a web by means of a collet tool having a slot for receiving closely spaced adjacent contacts. The web is wound on a reel carried on a fixture shaft with a nylon plate on the shaft facing a nylon plate on the fixture to properly tension the web.

4 Claims, 9 Drawing Figures

SPECIAL CRIMPING COLLET MECHANISM WITH REELING AND UNREELING TECHNIQUE ON STRIP CONTACTS

BACKGROUND OF THE INVENTION

1. Field of the Invention

This invention relates in general to an improved crimping method and apparatus and more particularly to an improved method and apparatus for providing a crimped skirt and contact assembly.

2. Summary of the Prior Art

Receptacle contacts are often formed with longitudinally extending spring fingers or legs for receiving a male or pin contact therebetween. The spring fingers are subject to a distorting force arising for example from misalignment with a pin or male contact or improper tolerances or from engagement with a foreign or sharp object, and the contact may become distorted or useless.

Stamped contact forms which are rolled into a female or receptacle contact to provide the spring fingers or legs have considerable economic attraction. The contact is split longitudinally and is rather fragile, however. It therefore is important to provide the receptacle contact with some means of protection and this is usually a tubular skirt or hood, which overlaps the contact legs and has a lip at one end to both protect the receptacle contact leg ends and to steer or guide the male pin contact into the proper engagement with the female contact, and prevent insertion of an oversize member.

In order to fix the skirt on a female or receptacle contact, the hood is deformed at the end opposite the lip into a reduced outer diameter portion or recess of the receptacle contact. The hood may be fixed to the contact in conventional crimping apparatus, but such apparatus usually requires a complicated arrangement of levers and jaws and a stamped contact cannot be conveniently handled on the web from which it is formed since the web is fragile and the contacts are closely spaced. Therefore practically in order to secure a hood to a female contact, the female contact is first formed in a split bar or rod and the hood is deformed adjacent one end into the recess by spinning. This renders the process together with the contact and hood assembly relatively expensive.

SUMMARY OF THE INVENTION

The present invention proposes a simple solution to the above and other problems of securing a hood or skirt to a stamped receptacle contact, while the stamped receptacle contact is still attached to the web on which it is formed.

Thus the stamped contacts which are each attached at closely spaced positions to a web are conventionally wound on a reel. The reel is then placed on a reel fixture for rotation and the contacts and web are unwound from the reel. A hood is slipped over the spring legs of each contact to frictionally engage the contact, as the web is unwound, whereafter the contact and hood are inserted in the central opening of a collet tool.

The collet tool is provided with a stop for ensuring the proper longitudinal positioning of the hood relative the contact jaws of the collet tool. The tool is also provided with diametrically extending slots or passageways for receiving the adjacent closely spaced contacts attached to the web.

The collet tool is then conventionally moved in one axial direction into a tapered chuck which causes the jaws of the collet to close to crimp the portion of the hood opposite the hood end engaging the stop into a recess of the contact for securing the hood to the contact. The collet tool is then released to open its jaws and the contact with the attached crimped hood is then withdrawn from the jaws to permit insertion of the next contact and hood. The web with the attached contacts are thus paid off their reel and the web and contacts with the attached hoods simply wound on another reel at a fixture identical to the pay-off fixture in a continuous strip and process. A quick, efficient and economical method of crimping of the hood or skirt on the contact is thus provided.

The fixtures for winding and unwinding the web and contacts incorporate an unusually simple and economical feature for preventing over-running of the reel and contacts while at the same time avoiding such tension on the fragile web as would fracture or deform either the contacts or web. This feature is a simple provision of two nylon plates spring biased against one another with one plate fixed to the stand supporting the reel on which the contacts are wound and the other plate rotatable with the reel to provide just the right balance of frictional forces for enabling the reel to move freely without overrunning or requiring too much tension on the web.

It is therefore a primary object of the invention to provide an improved and more economical method and apparatus for assembling a hood to a contact.

Other objects and features of the present invention will become apparent on examination of the following specification and claims together with the drawings.

DESCRIPTION OF THE INVENTION

Figures 1, 1A, 1B:
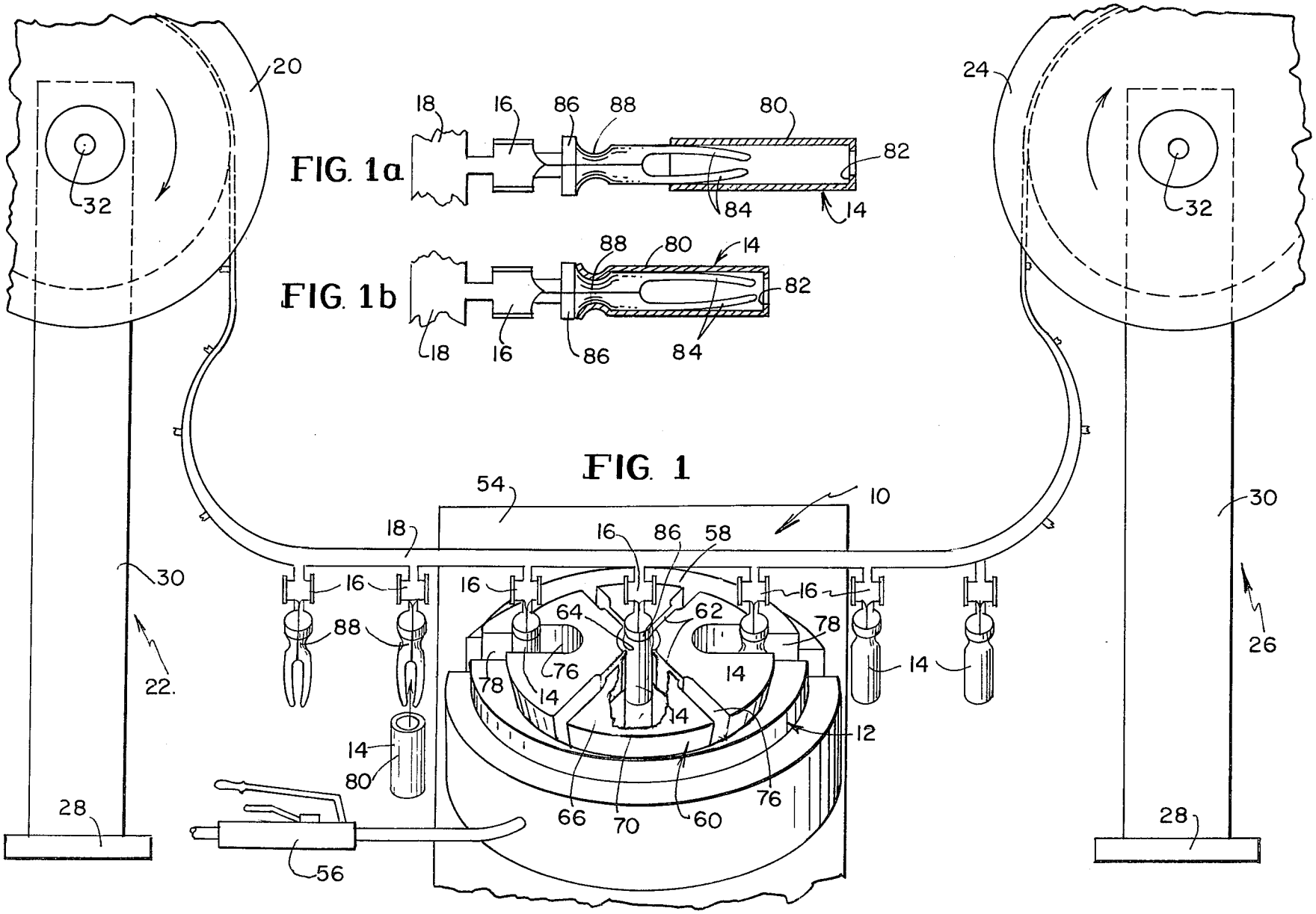
FIG. 1 illustrates the method and apparatus of the invention wherein the web and contacts are unwound from a reel on one reel fixture for placing a hood on each contact and each hood crimped on the respective contact at a collet tool and the web, contact and hood are then wound on a second reel.
FIG. 1*a* is a fragmentary view illustrating a web portion with attached contact and a hood partialy assembled thereto.
FIG 1*b* is a fragmentary view illustrating a web portion with a hood attached to a contact on the web portion.

In FIG. 1, apparatus for practicing the method of the invention is indicated by the reference character 10. The apparatus includes a conventionally operated collet tool 12, shown partially broken away in FIG. 1, for crimping a hood or skirt 14 on each contact 16 of a plurality of contacts 16 attached to a web 18. The web 18 together with the contacts 16 are initially unwound from a reel 20 rotatably carried on a reel or pay-off fixture 22. A station located intermediate the pay-off fixture 22 and the collet tool 12 is provided at which the tubular skirt or hood 14 is assembled over the free end of the contact 16. The hood and contact is then inserted into the central opening of the collet tool 12 as indicated in FIG. 1 with the adjacent contacts and their assembled hoods received in diametrically extending slots in the tool. The collet tool is then conventionally operated to crimp the hood 14 on the associated contact 16 without damaging the adjacent contacts and hoods, when the collet jaws close. As the hoods are crimped on respective contacts, the web and attached contacts and hoods are then wound upon a second reel 24 at a windup fixture 26 identical to fixture 22.

Figure 2:
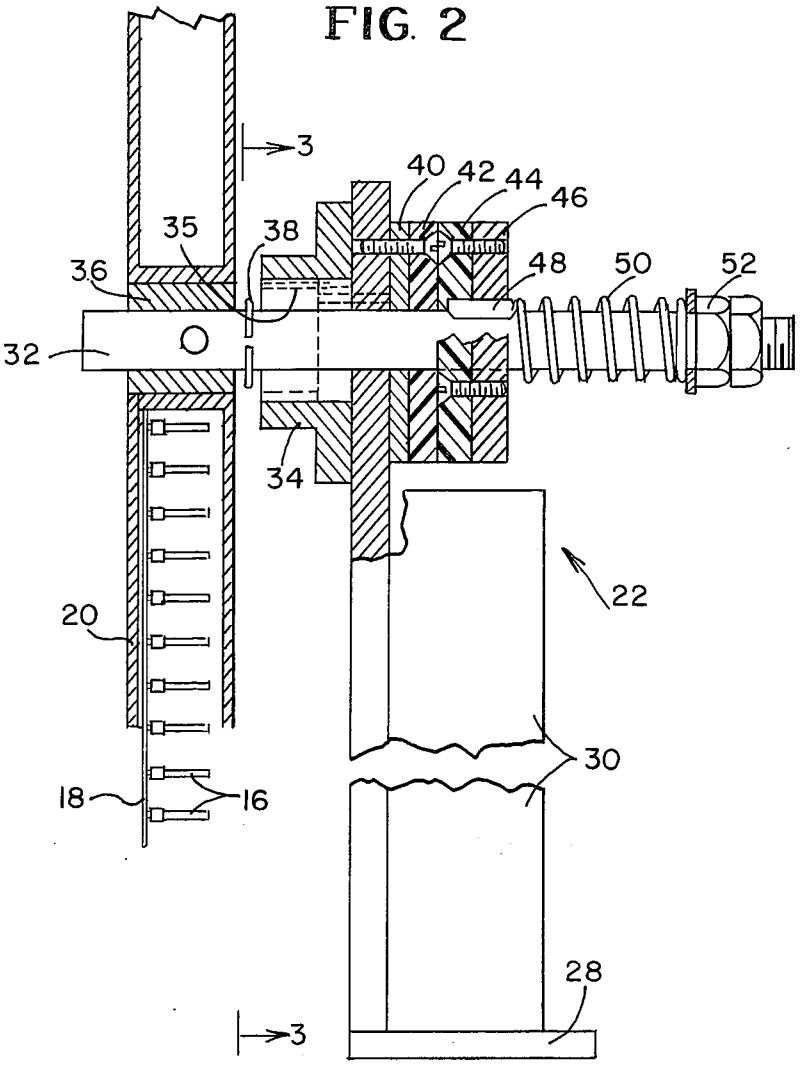
FIG. 2 is a sectional view of one of the reel fixtures.
Figure 3:
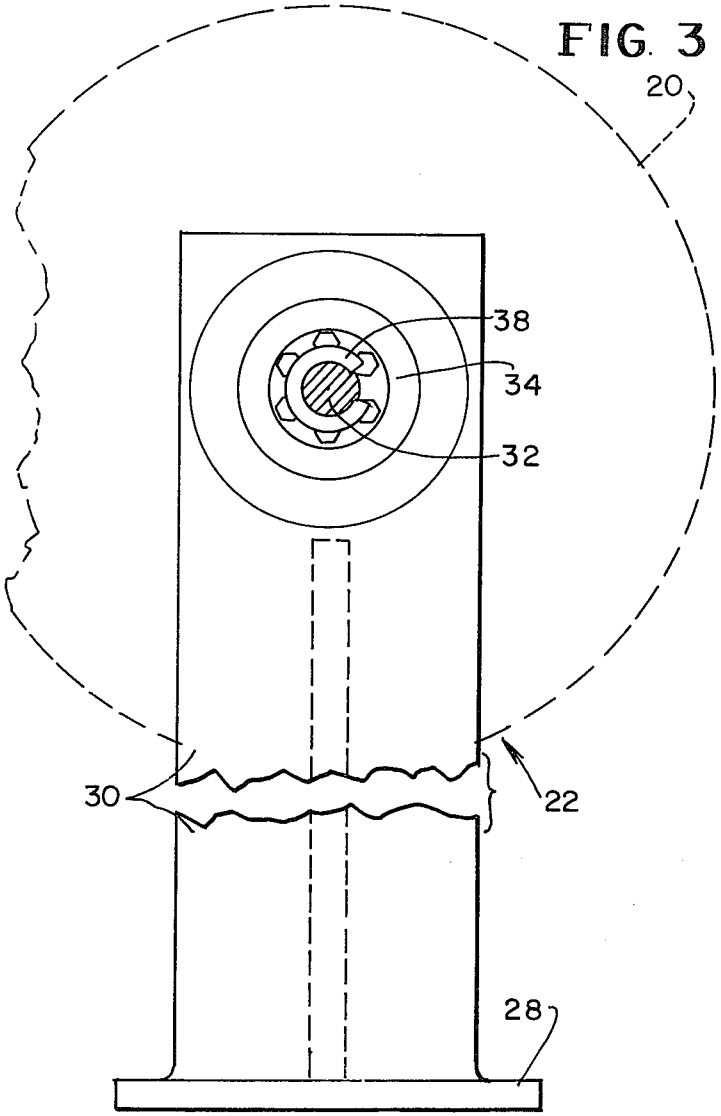
FIG. 3 is a sectional view taken along the line 3—3 in FIG. 2 of the reel fixture.
Figure 4:
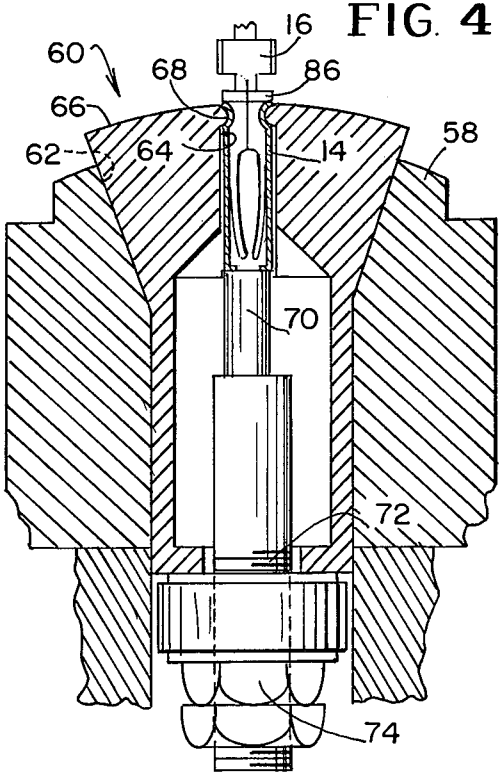
FIG. 4 is a sectional view of the relevant portion of the collet tool.
Figure 5:
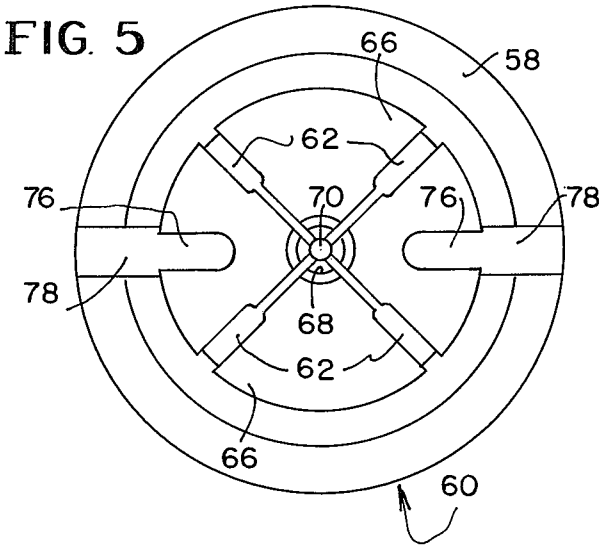
FIG. 5 is a front elevational view of the relevant portion of the collet tool to illustrate the slots for receiving contacts adjacent the crimped hood and contact.

As may be seen by reference to FIGS. 2 and 3, the reel fixtures 22 or 26 each comprise a base member 28 on which a standard 30 is provided rotatably carrying a shaft 32 in a conventional ball bearing member 34 indicated by dotted lines 35 to hold the shaft against the weight of the reel. The shaft 32 projects on opposite sides of the standard 30 and one end has a hub member 36 secured thereto which is sized in correspondence with the opening in the reel 20 and is selected to accommodate reels of various sizes. A retaining ring 38 is located on the shaft between the hub member 36 and the bearing member 34.

The other end of the shaft 32 extends through a pair of plates 40 and 42 fixed to the side of standard 30 opposite bearing member 34 and the shaft 32 then extends through plates 44 and 46 which are keyed to rotate with the shaft 32 by a key 48. The plates 44 and 46 are secured together and biased towards the standard 30 by a coil spring 50 for engaging the radial faces of plates 42 and 44 with the back plates 40 and 46 serving to stiffen the nylon plates. The tension or bias of spring 50 is adjusted by means of a nut arrangement 52 on a threaded end of the shaft 32.

The plates 42 and 44 are formed of nylon and are machine finished so that a very slight grooving appears therein which is just sufficient under the biasing force of spring 50 to prevent the reel 20 from rotating freely and thereby creating an excessive loop of web and contacts in response to the operator pulling the web from the reel or creating excessive restraining force so as to result in tearing of the web when the operator pulls the web from the reel.

The collet tool 12 may be conveniently located in a stand 54 carried on a table and is conventionally operated by pneumatic or other pressure in response to the operation of a gating device 56 for controlling a solenoid valve. The tool 12 comprises a chuck 58 having a collet 60 for reciprocating movement in a passageway of the chuck 58 in response to the application of pressure in one direction when the operator operates the gating device 56 and for reciprocating movement in the opposite direction in response to the release of the gating device.

The collet 60 has a conventional tapered periphery engaged against the chuck passageway wall and a plurality of diametrical slots 62 in its front end extending to an opening or central passageway 64 for receiving the hook 14 and contact 16. The diametrical slots or passageways define radially inwardly movable potions 66 of the collet on which annularly shaped jaws 68 are formed in the passageway 64. Thus the collet 60 assumes a smaller diameter in response to movement in one or inward direction relative the chuck 58 to move the jaws 68 radially inwardly. An elongate stop 70 is located in the passage 64 at a position spaced from the front end or face of the collet 60 to control the position to which the hook 14 and contact 16 are inserted in the passageway 64. For this purpose the collet 60 is provided with thread adjacent the end opposite the front face for engagement with threads 72 on the opposite end of the stop. A lock nut 74 ensures that the adjusted position of the stop is retained. A pair of diametrically opposed wide slots or passageways 76 extending from the periphery of a collet and terminating radially outwardly of the central passageway are also formed in the front face or wall of the collet 60 for receiving the contacts and hoods of the closely spaced contacts on the web adjacent the contact and hood located in the central passageway 64. These slots serve also as a guide and to align the web and contacts properly with the central opening for movement into the opening. The chuck is also provided with passageways or slots 78 aligned with slots 76 to permit closing of the collet tool jaws, however, the slots 78 terminate in narrow portions to avoid weakening the walls.

In operation then, a reel 20 carrying web 18 and a plurality of attached contacts 16 is placed on the reel fixture 22 and the web 18 is pulled from the reel 20. A paper web is usually located between the web turns on reel 20 and may be discarded or it may be interleaved between turns of the web when it is wound on reel 24. A hood or skirt 14 as indicated in FIGS. 1 and 1a, is assembled to each contact 16 as it passes the station intermediate reel 20 and tool 12.

The hood 14 as before described, comprises a tubular or annular portion 80 terminating in a radially inwardly extending annular lip 82 at one end. The contacts 16 are rolled into a generally annular shape with a seam and comprise a pair of bifurcated or spring legs 84 having a free end for location adjacent lip 82. The legs 84 taper radially inwardly towards their free ends to provide gripping action on the mating pin contact. A shoulder or annular collar 86 is provided intermediate the web and spring legs 84 together with a recess 88 intermediate the shoulder 86 and the free end of the contact legs 84.

Figure 6:
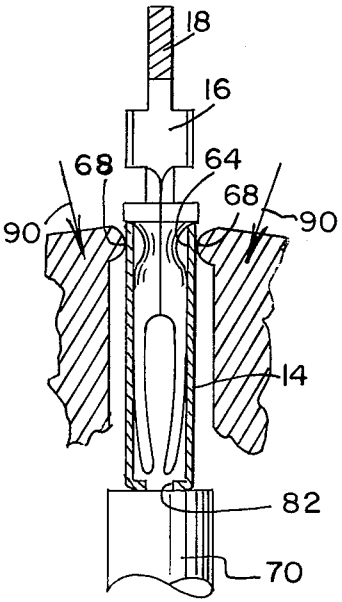
FIG. 6 is a fragmentary sectional view illustrating the collet jaws in position to crimp a hood on a contact.

The hood 14 is assembled to the contact 16 until the tubular portion 80 at its end opposite lip 82 abuts the shoulder 86 overlapping the recess 88, with the lip 82 adjacent the front or free end of the contact legs 84. The internal diameter of the hood is sized so that it is frictionally engaged or held by the spring legs, and the hood and contact to be crimped are inserted in the passageway 64 of the collet 60 while the closely spaced adjacent contacts and hood are received in the respective diametrically opposed slots 76 and/or 78. As the contact and hood extend into the passageway, the front or lip end of the hood 14 engages the stop and ensures the opposite end of the hood engages the collar which positions the contact recess 88 in alignment with the jaws 68 of the collet 60. When the gating device 56 is operated, the collet 60 is moved inwardly of the chuck 58 to move the jaws 68 radially inwardly of the contact as indicated by arrows 90 in FIG. 6 to crimp the end of the hood 14 into the recess 88 and thereby secure the hood 14 to the contact. The gating device is then released and the collet tool reciprocates in the opposite direction to open the jaws 68 whereupon the contact and crimped skirt are removed from the passageway 64 and the next skirt and contact inserted therein. In this manner, each of the contacts 16 may have a hood 14 crimped thereto and the contacts and skirt attached to the web are wound on the second reel 24 on the windup fixture 26 with a paper web preferably interleaved with the web turns.

Figure 7:
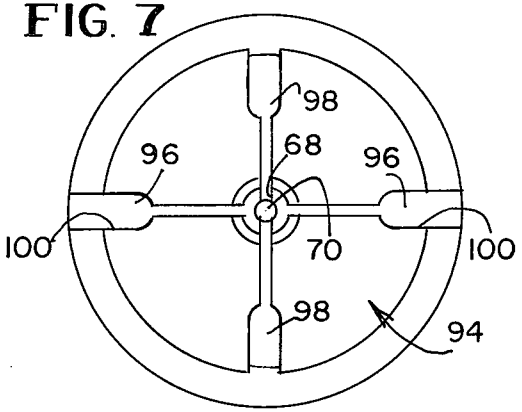
FIG. 7 is a front elevational view of another collet tool.

On FIG. 7, a collet tool 94 of simplified construction is illustrated. In this case, two pair of diametrically opposed slots 96 and 98 are provided each extending to the central passageway. In this case, instead of providing four relating narrow slots such as 62, two diametrically opposed or extending slots 96 are provided with widened portions 100 at a position spaced from the central passageway. This ensures proper operation of the collet tool and yet provides sufficient space to insert the contacts and hoods adjacent the contact received in the central opening.

The foregoing constitutes a description of an improved method and apparatus for assembling contact or hoods to contacts and while other embodiments are possible, it is believed that the accompanying claims set forth the inventive concept.

What is claimed is:

1. A tool for crimping a hood on one contact carried on a web carrying spaced adjacent contacts comprising:

a collet having a central passageway for receiving said one contact and hood and having a pair of slots extending in opposite radial directions relative to said central passageway, each said slot having a portion for receiving one of said closely spaced adjacent contacts; and a tapered chuck receiving said collet for movement in one direction therein to reduce the radial dimension of said central passageway for crimping said hood on said one contact the walls of each said slot receiving one of said closely spaced adjacent contacts being spaced from said closely spaced contacts to avoid deformation of said adjacent contacts in response to the reduction in the radial dimension of said central passageway.

2. In the tool claimed in claim 1, a stop positioned in said central passageway for controlling the axial position of said hood and contact in said central passageway, and annulary shaped inwardly projecting means on said collet for crimping said hood on said one contact at a predetermined axial position controlled by the position of said stop.

3. In the tool claimed in claim 2, means for adjustable axial positioning of said stop in said central passageway.

4. The tool claimed in claim 1 in which an annularly shaped split jaw projecting radially inwardly of said central passageway is provided in said central passageway adjacent one end of said passageway for crimping said hood on said one contact at a selected axial position.

* * * * *

UNITED STATES PATENT OFFICE

CERTIFICATE OF CORRECTION

PATENT NO. : 3,956,918

DATED : May 18, 1976

INVENTOR(S) : Anumolu S. Rao

It is certified that error appears in the above-identified patent and that said Letters Patent are hereby corrected as shown below:

Column 5, Line 26, after "carrying" insert -closely-.

Signed and Sealed this

Fourteenth Day of September 1976

[SEAL]

*Attest:*

RUTH C. MASON
*Attesting Officer*

C. MARSHALL DANN
*Commissioner of Patents and Trademarks*